US005429577A

United States Patent [19]

Simpson et al.

[11] Patent Number: 5,429,577

[45] Date of Patent: Jul. 4, 1995

[54] MULTI-PURPOSE ROTARY SLIT-SCORER AND PRODUCTS FORMED THEREBY

[75] Inventors: Jack R. Simpson, Raleigh; Jeffrey A. Geer, Apex, both of N.C.

[73] Assignee: Container Graphics Corporation, Cary, N.C.

[21] Appl. No.: 221,538

[22] Filed: Mar. 31, 1994

Related U.S. Application Data

[63] Continuation of Ser. No. 863,446, Apr. 3, 1992, abandoned.

[51] Int. Cl.[6] ..... B31B 1/14; B31F 1/00

[52] U.S. Cl. ..... 493/354; 453/367; 83/620; 83/660

[58] Field of Search ..... 493/63, 354, 355, 367, 493/370, 372; 83/620, 660, 695

[56] References Cited

U.S. PATENT DOCUMENTS

| | | | |
|---|---|---|---|
| 1,473,089 | 11/1923 | Faust . | |
| 2,830,506 | 4/1958 | Burroughs . | |
| 3,119,312 | 1/1964 | Henc . | |
| 3,205,750 | 9/1965 | Strange | 493/63 |
| 3,255,648 | 6/1966 | Buttery | 493/63 |
| 3,280,682 | 10/1966 | Sauer . | |
| 3,383,969 | 5/1968 | Saunders . | |
| 3,386,323 | 6/1968 | Dovey . | |
| 3,395,598 | 7/1968 | Martin . | |
| 3,786,708 | 1/1974 | Mumper | 493/372 |
| 3,795,164 | 3/1974 | Schneider | 83/349 |
| 4,020,724 | 5/1977 | Quinlan | 83/346 |
| 4,596,541 | 6/1986 | Ward et al. | 493/59 |
| 5,001,956 | 3/1991 | Nitsch | 493/372 |
| 5,156,584 | 10/1992 | Cohen | 493/354 |

*Primary Examiner*—Jack W. Lavinder

*Attorney, Agent, or Firm*—Bell Seltzer Park & Gibson

[57] ABSTRACT

Toothed perforating rules upon the die roll of the rotary die apparatus form tear strips, punch-outs, reverse fold lines, nicking connections and similar weakened or frangible sections in corrugated paperboard sheets during passage thereof through the nip between the die and anvil rolls of the apparatus. The teeth of the die rules are tapered and sharpened, and produce perforations in the paperboard panel that decrease in size with increasing distance from the inner liner of the paperboard sheet. The teeth produce an array of relatively long slits in the inner liner of the sheet, and underlying shorter slits within at least one other ply of the panel. The toothed die members may extend at any desired angle or angles relative to the machine direction of the apparatus and/or relative to the direction of the corrugations within the paperboard panel. The rotary die apparatus may and customarily would include, in addition to the aforesaid perforating rule members, cutting die members, and product and/or scrap ejection members.

41 Claims, 7 Drawing Sheets

MULTI-PURPOSE ROTARY SLIT-SCORER AND PRODUCTS FORMED THEREBY

RELATED APPLICATIONS

This application is a file wrapper continuation of application Ser. No. 07/863,446 filed 3 April 1992, now abandoned the disclosure of which is incorporated by reference herein in its entirety.

FIELD OF THE INVENTION

This invention relates to corrugated paperboard sheets used in the manufacture of boxes, cartons and the like, and to rotary die elements and apparatus for shaping such sheets.

BACKGROUND OF THE INVENTION

Paperboard sheets such as are used in the manufacture of cartons, boxes and other die cut products, may be cut, trimmed, creased, perforated and/or otherwise "shaped" in a number of different ways. This may be done manually; by reciprocating flat dies; by sequentially subjecting each panel to the action of a plurality of discrete machines which respectively perform different ones of the desired cutting, slitting, perforating or other operations needed for desired shaping of the panel; or by use of a rotary die apparatus. When the number of sheets is sufficiently large, they can be most efficiently shaped by a rotary die apparatus. This is due to the high speed at which a rotary die apparatus operates, and also to its ability to substantially simultaneously perform a plurality of different shaping operations upon a sheet during single passage of it through the nip between cooperating die and anvil rolls of the apparatus. However, the prior art rotary die apparatuses have not heretofore produced tear strips, punch-outs, foldable creases, nicking connectors and similar weakened or "frangible" sections of optimum quality. Additionally, the prior rotary die apparatuses have not been able to form fold lines about which thereto adjacent panels of a paperboard sheet freely can undergo relative reverse pivotal movement, i.e., movement bringing the outer "printed" liners of the panels toward each other.

The metal die rule element customarily employed in a rotary die apparatus for forming tear strips, punch-outs, and similar perforate connectors has a plurality of relatively wide rectangularly shaped and laterally spaced teeth that extend outwardly from the base section of the rule and from the die board of the die roll. Except when the flat outer ends of the teeth have been recently sharpened, they do not easily or consistently penetrate the panels to the desired extent and tend to undesirably cut and/or crack the paperboard. When the frangible section of the panel is a tear strip, punch-out, nicking connector or the like, this makes it difficult or impossible for a person to readily and neatly tear the sheet at the desired frangible location(s). Another undesirable consequence of use of a perforating rule having rectangular teeth is the tendency of the paperboard sheet to adhere to the rule unless positively separated therefrom by product ejection means which may significantly reduce the strength of the sheet. Lastly, if the rectangular teeth of the rule penetrate through the printed outer liner of the sheet, they form perforations in it of the same large size as the perforations in the inner or kraft liner of the sheet. This undesirably detracts from the appearance of the box or other product formed from the sheet.

SUMMARY OF THE INVENTION

The present invention provides improved means, in a rotary die apparatus of the previously-described type, for providing corrugated paperboard sheets with frangible sections of greatly improved quality and, if desired, with fold lines having improved characteristics and capabilities. The invention is also directed to paperboard box panels and the like possessing the improved frangible sections and/or fold lines.

In a preferred embodiment of the rotary die apparatus of the invention, the die elements upon the die board of the die roll of the apparatus include at least one die member having an inner base section connected to the die board upon the die roll, and further having a plurality of sharp, tapered, laterally adjacent teeth extending outwardly from such base section. As a paperboard sheet passes through the nip between the die and the anvil rolls, the teeth upon each of the aforesaid toothed die member penetrate the paperboard sheet and form therein a plurality of perforations that each decrease in size with increasing distance from the inner kraft liner that is proximate the die roll. The perforations define in the inner liner a series of mutually spaced and generally aligned slits of relatively long length, and define elsewhere within the paperboard sheet slits that are parallel with the slits in the inner liner and that decrease in length with increasing distance from the inner liner. The teeth of the die member are of tapered and preferably generally triangular shape, and each have sharpened sloping edges that converge at the apex of the tooth and that preferably define substantially equal angles with a line extending perpendicularly from the base section of the die member through the tooth apex. The toothed die member(s) may extend at any desired angle or angles relative to the corrugations within the corrugated inner ply or plies of the paperboard sheet, and/or relative to the direction of movement of the paperboard sheet through the nip between the die and anvil rolls. The die member(s) may be curved and/or straight, and may have discrete spaced opposite ends or may be endless.

In a preferred embodiment the teeth of the toothed die member(s) have a pitch within the range of 4–6 teeth per inch. However, the size of the teeth and the extent of their projection toward the anvil roll of the rotary die apparatus vary in accordance with the thickness of the paperboard sheet and other factors.

DESCRIPTION OF THE PRIOR ART

U.S. Pat. No. 3,386,323 discloses a specialized apparatus having rotatable circular saw blades that slit paperboard panels so as to form an "accordion stack." Each of the rotating circular saw blades has inclined teeth that form a continuous cut in at least the proximate side of the panel throughout its entire length, and which are stated to be capable of producing a series of discrete slits upon the opposite side of the panel. Other U.S. patents of possible interest to the present invention are U.S. Pat. Nos. 4,596,541, 4,020,724, 3,795,164, 3,395,598, 3,383,969, 3,280,682, 3,119,312, 2,830,506 and 1,473,089.

DESCRIPTION OF THE PREFERRED EMBODIMENT

Figure 1:
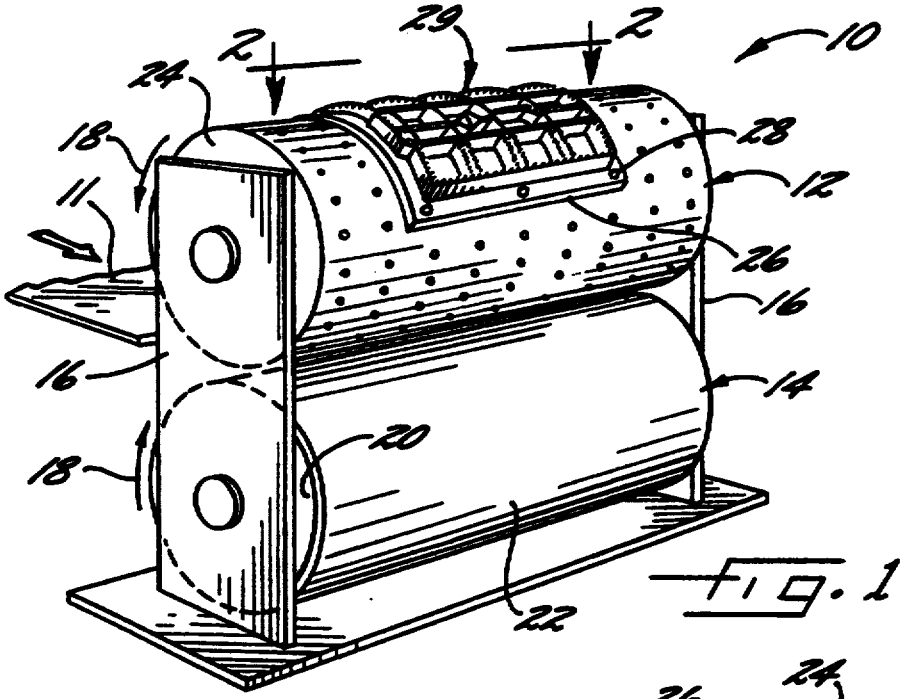
FIG. 1 is a partially schematic perspective view of a rotary die apparatus in accordance with the invention, and of a fragmentarily shown sheet of corrugated paperboard approaching the nip between the die and anvil rolls of the apparatus.

The rotary die apparatus identified in its entirety in FIG. 1 by the numeral 10 includes a die roll 12 and an anvil roll 14 that are mounted by suitable frame means 16 in closely spaced parallel relationship to each other. Rolls 12, 14 are of approximately the same diameter, and are adjustively movable toward and away from each other so as to adjust the height of the nip defined therebetween. During operation of apparatus 10, rolls 12, 14 are driven by suitable drive means (not shown) in opposite angular directions indicated by the arrows 18.

Anvil roll 14 is of a conventional construction, consisting of an inner cylindrical core member 20 having a layer of polyurethane or similar resilient and penetrable material 22 upon its outer surface.

Die roll 12 customarily and illustratively includes a cylindrical inner metallic member 24 and an arcuate die board 26. Die board 26 has a curvature complementary to that of the outer surface of die roll 24 and is releasably secured to the cylindrical outer surface of inner die roll member 24 by threaded fasteners 28 that extend into aligned threaded bores (not shown) of member 24.

Figure 3:
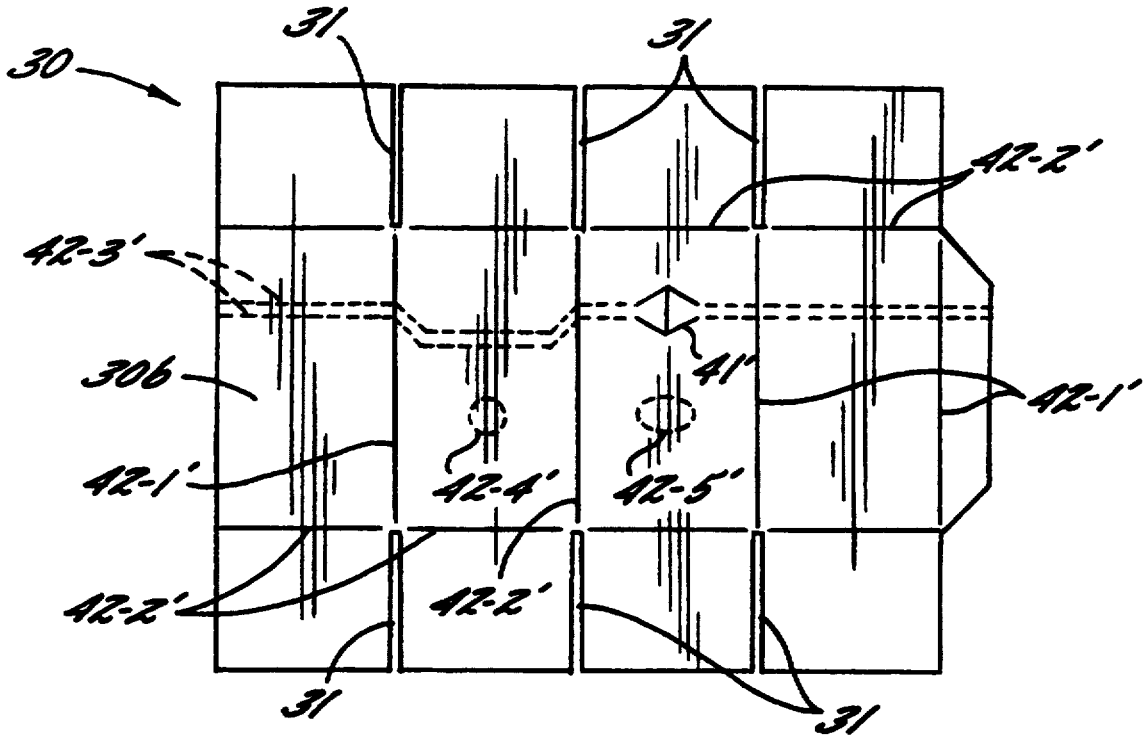
FIG. 3 is a top plan view of an unfolded paperboard box shaped by die members of the rotary die apparatus.

An assembly 29 of metal die rule members is mounted upon and projects outwardly from die board 26. The die rule members of assembly 29 cut, score, slit, perforate and/or otherwise shape corrugated paperboard sheet material 11 passing during operation of apparatus 10 through the nip between rolls 12, 14 so as to produce shaped corrugated paperboard products such as the box blank 30 shown in FIG. 3 and suitable for formation into the paperboard box 30' of FIG. 4. As is best shown in FIG. 6, blank 30 is of a conventional type having inner and outer liner plies 30*a*, 30*b* upon opposite sides of at least one inner corrugated ply 30*c*.

In addition to the die rule members of the above-mentioned type, die board 26 customarily and illustratively also mounts a plurality of product ejection members 32 and scrap ejection members 34. As is well known to those skilled in the art, these assist in ensuring proper release and discharge of paperboard panels 30 and scrap paperboard from die roll 12. The product ejection members 32 and scrap ejection members 34 upon die board 26 are illustratively of the types respectively disclosed in commonly assigned and copending U.S. patent application Ser. Nos. 07/692,577 and 07/709,922, and the therein contained disclosures of them are incorporated herein by reference.

The die rule members of assembly 29 (FIG. 2) include a plurality of conventional cutting rules 38, 40 that may be and illustratively are of the type having upon their radially outer edges a plurality of small pointed teeth of triangular shape. In cutting rules of this type, the distance between a plane containing the apexes of the teeth and a parallel plane containing the gullets of the teeth is substantially less than the thickness of a paperboard panel to be cut by the rule. In order to cut completely through the panel, the conventional cutting rule therefore must penetrate into the paperboard sheet to such an extent that the gullet plane of the rule member passes through the outer liner of the paperboard panel. The illustrative cutting rule members shown in FIGS. 1 and 2 include trim breaker rule members 36 that cut scrap trimmed from the leading edge of the paperboard sheet into smaller pieces; peripheral cutting rules 38 that shape the outer periphery of the sheet; slot forming rule members 40 that form slots 31 (FIG. 3) in the leading and trailing ends of the sheet; a pull tab forming member 41 for forming a pull tab associated with a tear strip forming member; and creasing members 42-1 for forming crease or fold lines 42-1' in the sheet.

Figure 5:
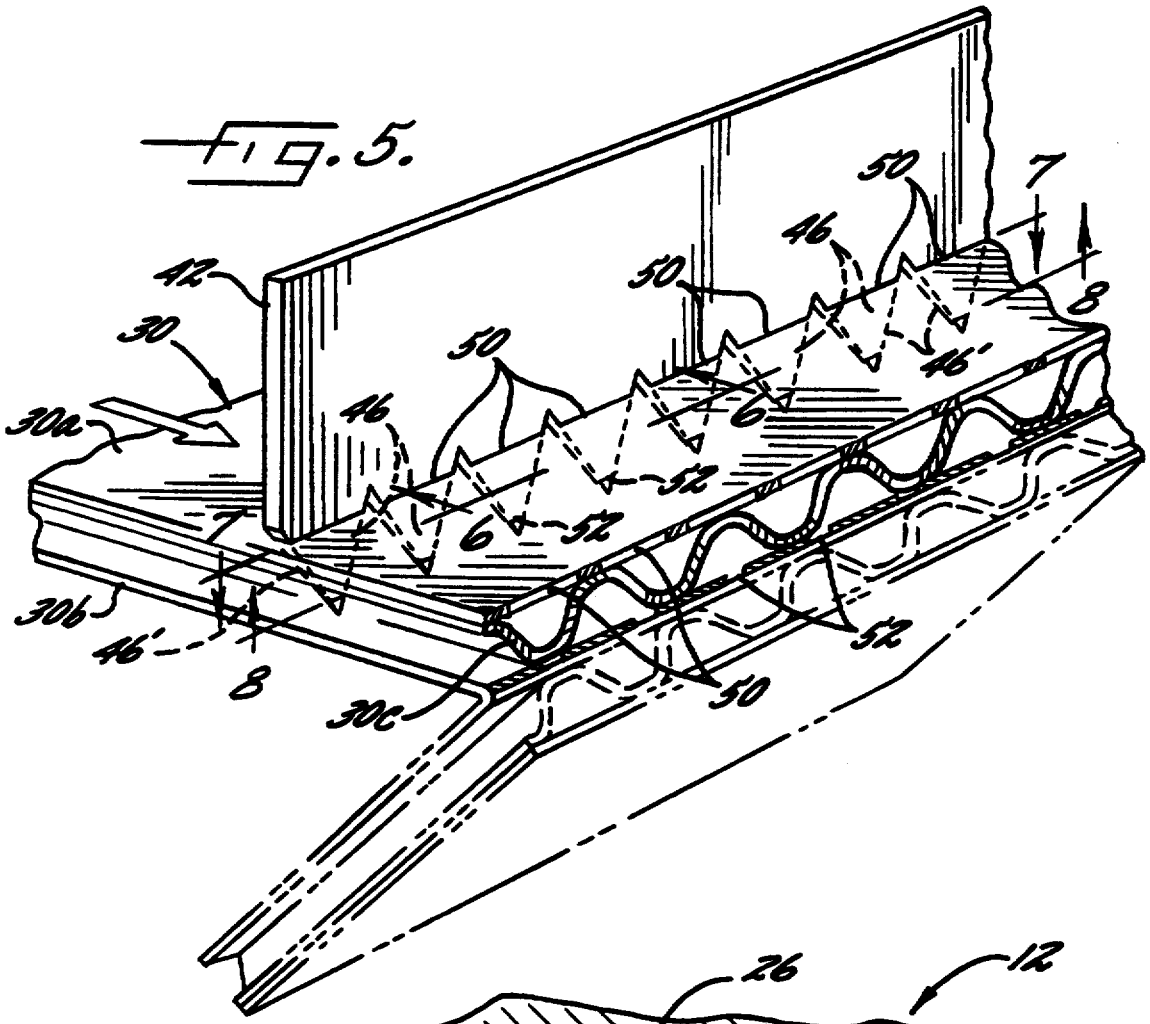
FIG. 5 is a fragmentary perspective view of teeth of a slit scorer die member of the apparatus engaging a paperboard sheet, and also showing in phantom lines a previously slit-scored and backwardly foldable part of the sheet.
Figure 6:
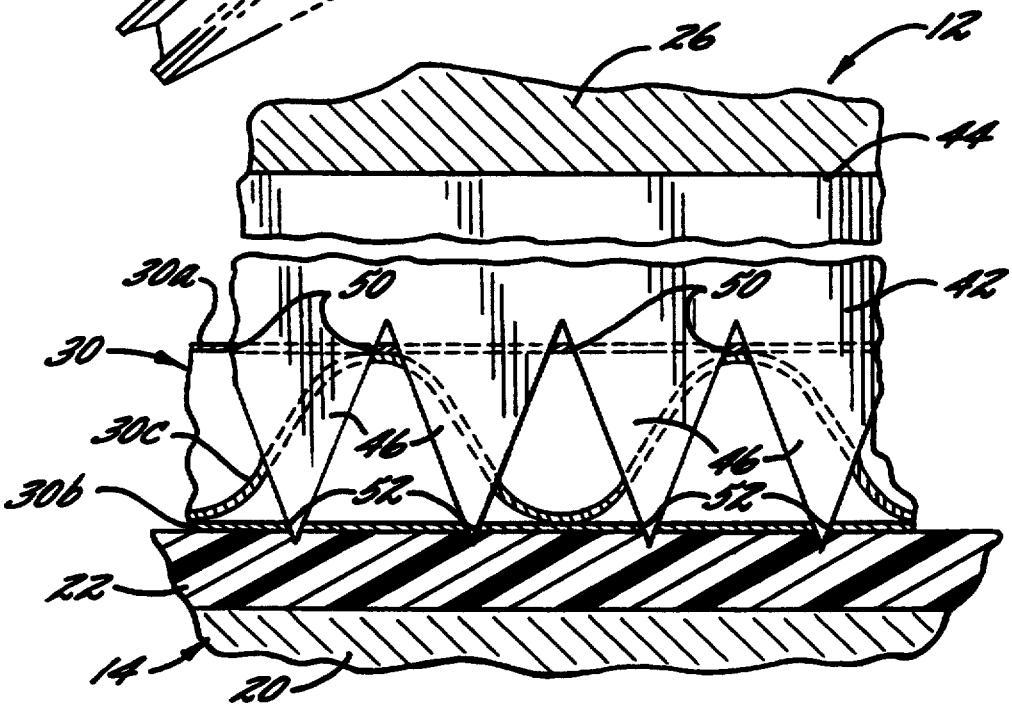
FIG. 6 is an enlarged fragmentary view, partially in elevation and partially in vertical section, taken in the direction of the arrows 6—6 of FIG. 5 and showing fragmentary parts of the die and anvil rolls of the die apparatus.
Figure 14:
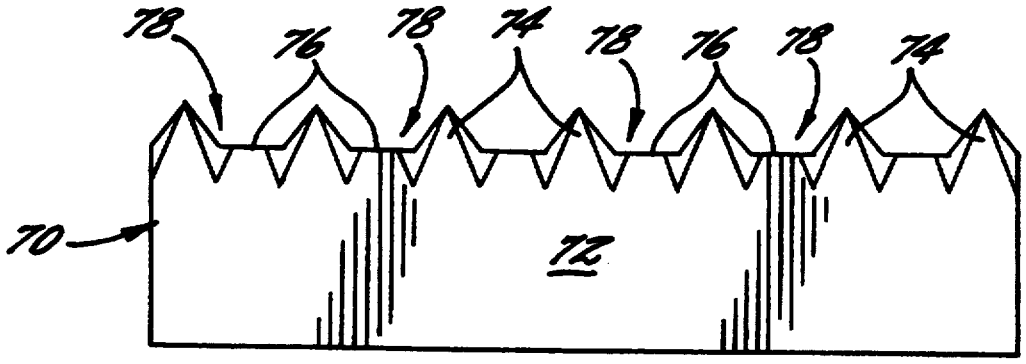
FIG. 14 is an elevational view of a straight slit scoring and creasing rule in accordance with the invention.
Figure 15:
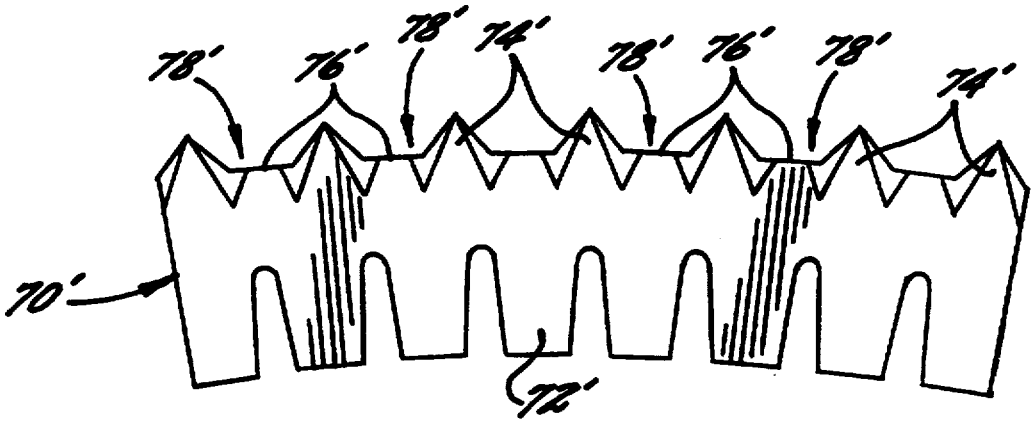
FIG. 15 is a view similar to FIG. 14 of a curved slit scoring and creasing rule.

In accordance with the present invention, the rule members upon die board 26 further include a plurality of slit scorer or perforating rule members 42 of a type fragmentarily shown in FIGS. 5 and 6. Each rule member 42 includes a base section 44 conventionally mounted within a slot of die board 26, and has a plurality of laterally tapered sharp pointed teeth 46, illustratively and preferably of triangular shape, that project outwardly from the base section. As used herein, the "lateral" direction is defined as the direction coincident with or parallel to a line extending between adjacent tooth points attached to the same base. Thus, a "laterally tapered" tooth is configured so that its central portion projects outwardly from the base at farther than does its lateral portions (exemplary of the lateral portions of a tooth element are the gullets between adjacent teeth illustrated in FIG. 6). Similarly, the term "laterally adjacent," when used to refer to tooth elements, means tooth elements that are adjacent to one another and which project from adjacent or proximate portions of the same base. Laterally adjacent teeth may either be immediately adjacent one another (as illustrated in FIG. 6) or proximate one another with a space therebetween (as illustrated in FIGS. 14 and 15). Teeth 46 of perforating rule members 42 are much larger than the teeth upon conventional cutting rules. They preferably have a pitch of about 4–6 teeth per inch, and a gullet depth within the range of about 0.100"–0.120". The laterally tapered sharp side edges 46' of each tooth 46 preferably and illustratively define substantially equal angles with a vertical plane transversely bisecting the tooth. In contrast to the rectangularly shaped teeth of the prior art perforating or slit-scoring rules, the tapered teeth 46 of rules 42 readily penetrate into the paperboard stock without significantly crushing it. Additionally, they retain their sharpness for a longer period of time than the rectangularly shaped teeth of the prior art perforating rules, and are less likely to adhere to the paperboard sheet material. Consequently less (and possibly no) ejection rubber is needed to separate the paperboard product from the die roll. This in turn reduces the possibility of the rubber crushing the product and thereby reducing its compression strength.

Figure 7:
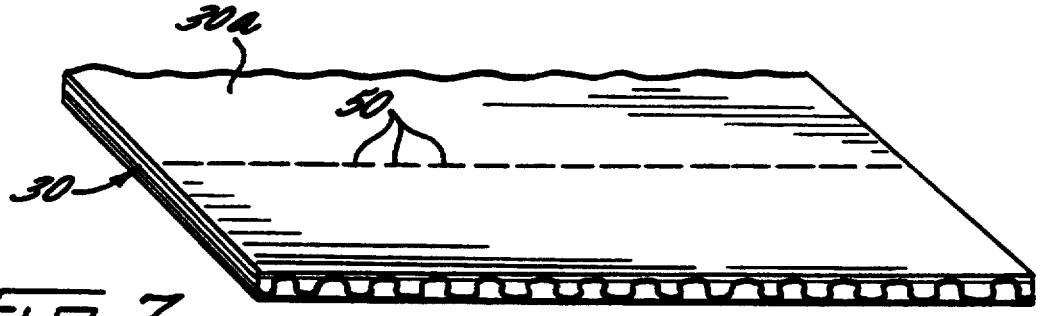
FIG. 7 is a perspective view of slits formed in the inner liner of a paperboard sheet by a toothed perforating rule member of the die apparatus.
Figure 8:
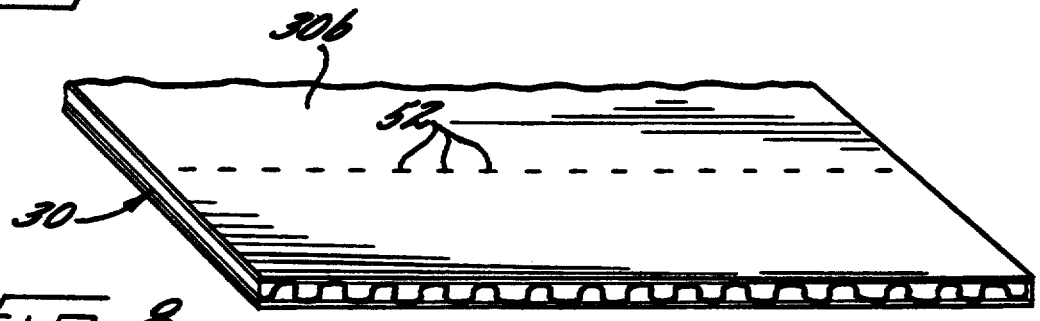
FIG. 8 is a perspective view of slits formed substantially simultaneously in the opposite outer liner of the paperboard sheet of FIG. 7 by the same toothed perforating rule member.

Another difference between the rules 42 and the prior art perforating rules, which form perforations in the paperboard sheet that are the same width throughout the thickness dimension of the sheet, is that the rule members 42 create tapered perforations which decrease in width with increasing distance from the paperboard inner liner 30*a* that is proximate die roll 12. Consequently, and as is best shown in FIG. 5, the perforation formed by each tooth 46 that penetrates completely through panel 30 forms a slit 50 in the inner liner 30*a* of a first length such as that shown by way of illustration and designated by the numeral 50 in FIG. 5; at least one underlying shorter length slit (not shown) in corrugated ply 30*c*; and a still shorter underlying slit 52 within the outer liner ply 30*c* adjacent anvil roll 14. The difference in length of the slits 50, 52 respectively formed in liners 30*a*, 30*b* of the illustrative sheet 30 is also shown in FIGS. 7 and 8. The lengths of the slits 50, 52 are of course illustrative only. If the extent of the penetration of panel 30 by teeth 46 were greater than shown in FIGS. 5 and 6, the lengths of slits 50, 52 would be longer and the slits 50 in inner liner 30*a* might interconnect with each other. Similarly, if the extent of penetration of panel 30 were of lesser magnitude, the slits 50, 52 would be shorter and slits 52 might not extend through face ply 30*b*.

The extent to which teeth 46 penetrate into a paperboard panel is dependent upon the panel thickness, the size of the teeth, the extent to which rule member 42 projects outwardly from die board 26, and/or upon the nip distance between rolls 12, 14 (FIG. 1), and can be adjusted by changing any of the foregoing parameters. Such adjustment in turn permits the formation of panel fold lines, tear strips, punchouts, and other frangible connections having different desired characteristics.

Figure 2:
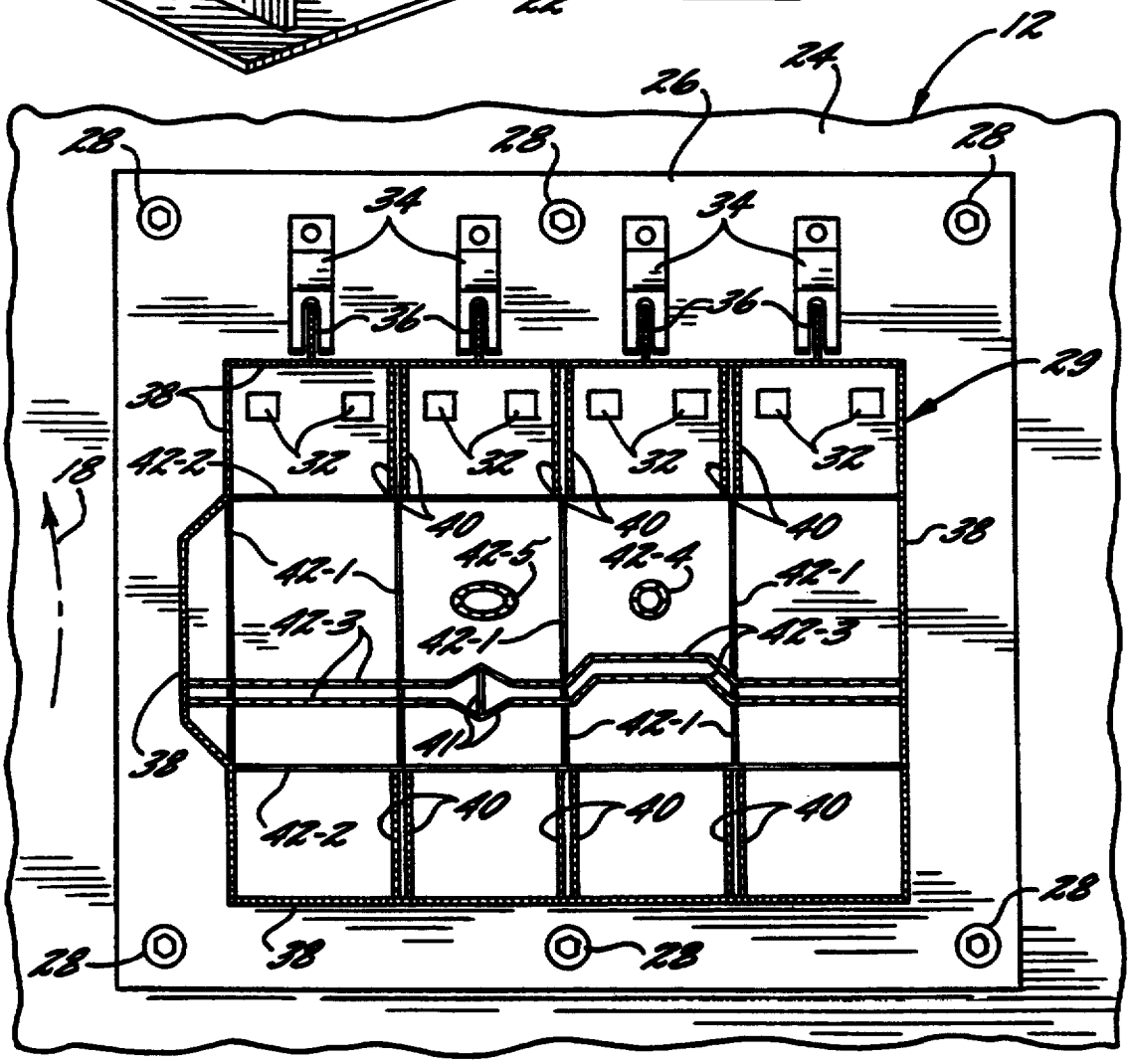
FIG. 2 is a flattened top plan view, looking in the direction of the arrows 2—2 of FIG. 1, of die members upon the die board of the die roll of the apparatus.
Figure 4:
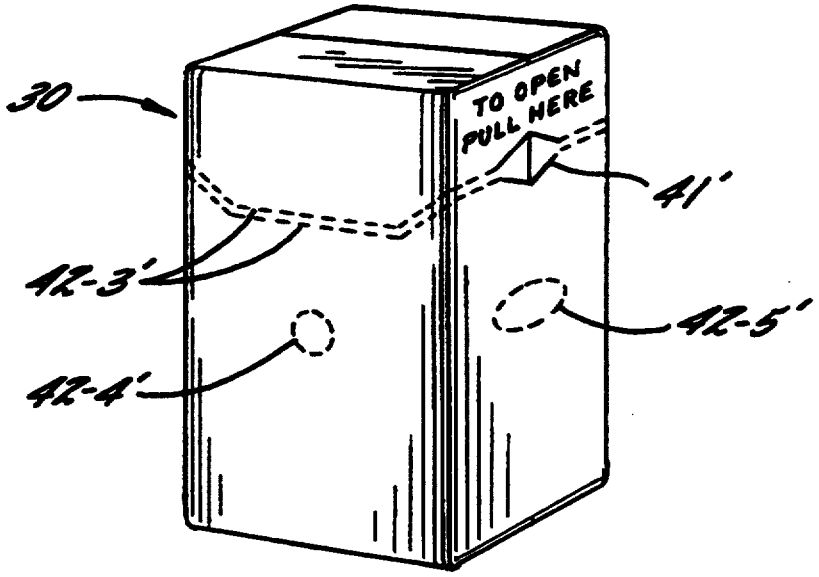
FIG. 4 is a perspective view of the box of FIG. 3 after folding thereof.

The perforating rule members 42 shown by way of illustration in FIG. 2 include ones of different shapes and orientations. The rule members 42-3 have sections that extend perpendicular to the machine direction and other sections that extend in oblique relationship to the machine direction. They could of course also extend parallel to the machine direction. They form tear strip lines 42-3' (FIGS. 3 and 4) in box blank 30. Rule elements 42-4 and 42-5 are of endless circular and oval shape, and respectively form circular and oval punchout lines 42-4' and 42-5' in box blank 30. The lines 42-3', 42-4', and 42-5' are also shown in the FIG. 4 illustration of the folded box formed from the shaped paperboard sheet.

Figure 9:
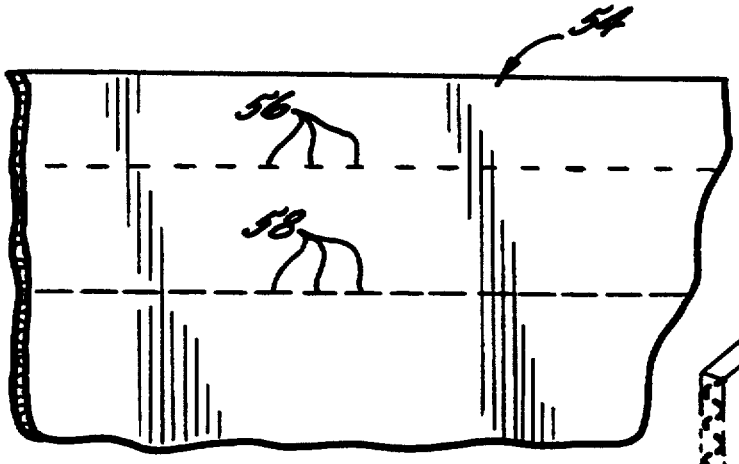
FIG. 9 is a fragmentary plan view of a paperboard sheet having parallel fold lines defined by first and second arrays of slits of first and second different lengths upon the same side of the panel.
Figure 10:
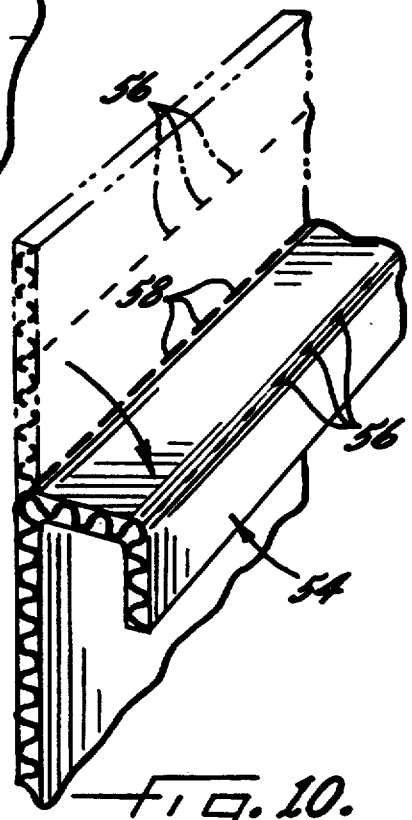
FIG. 10 is a perspective view illustrating sequential folding of the sheet of FIG. 9.

FIGS. 9 and 10 of the drawings show a fragmentary portion of a paperboard sheet 54 having upon the illustrated side thereof substantially parallel fold lines 56, 58 about which sequential folding of the panel is to occur firstly about the fold line 58 and thereafter about fold line 56. In accordance with the present invention, the desired sequential folding of the panel ensues when, as shown, the fold lines are formed by toothed rule members in accordance with the present invention and the rule member used to form fold line 58 produces slits in paperboard panel 54 that are longer and closer together than the slits that define fold line 56. The difference in length of the slits of the two fold lines can be achieved, as described above, by using first and second rule members that have different size teeth, or that project different distances from the outer surface of die roll 24.

The foregoing technique of forming fold lines, in a desired sequence or otherwise, can be employed when the fold lines extend in the machine direction, or perpendicular to the machine direction, or at any intermediate angle. The fold lines may be parallel to the corrugations of the paperboard sheet, or perpendicular to such corrugations, or at any intermediate angle relative to the corrugations.

Figure 11:
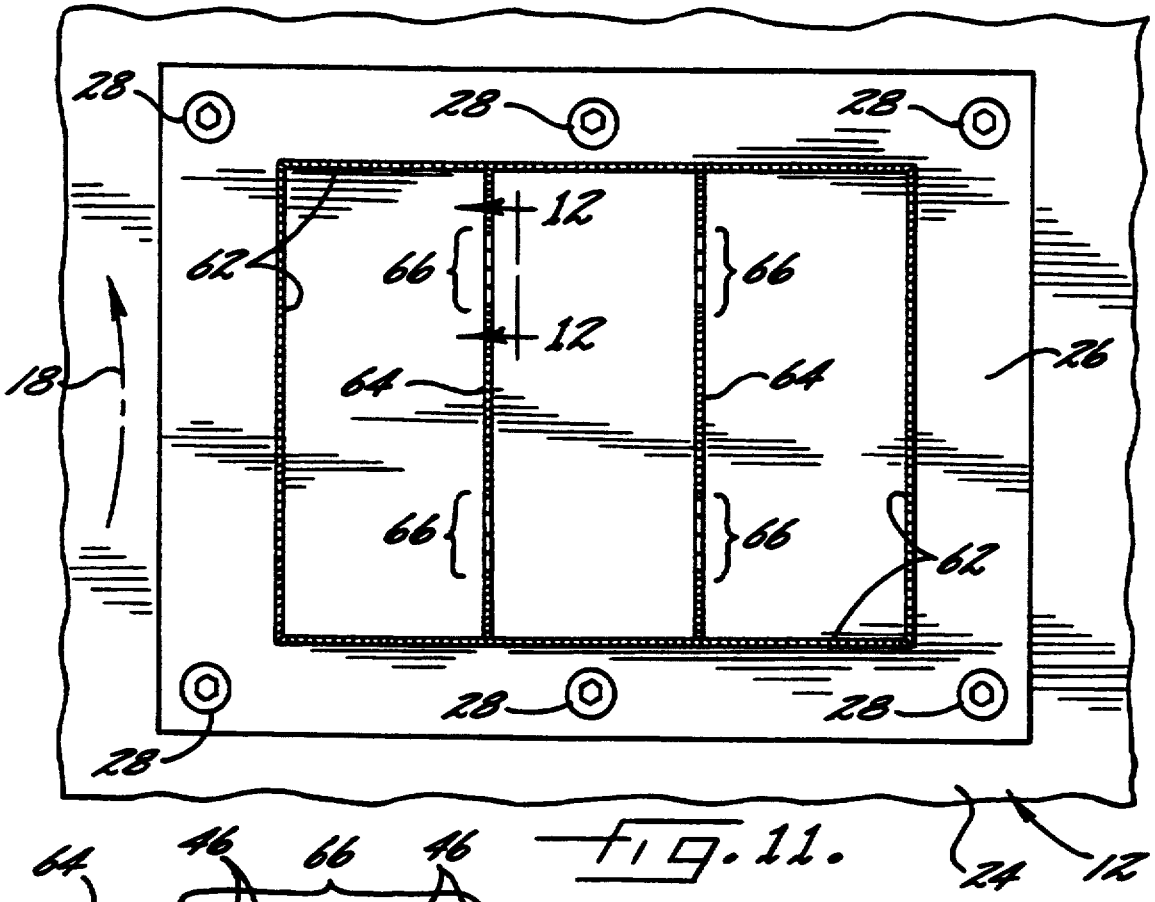
FIG. 11 is a flattened plan view of another embodiment wherein the die members upon the die board of the die apparatus are adapted to form a paperboard sheet into three adjacent panels joined together by frangible nicking connectors in accordance with the invention.
Figure 12:
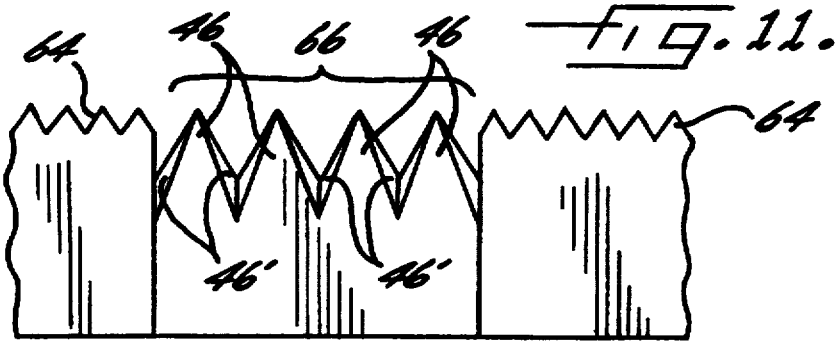
FIG. 12 is a fragmentary elevational view, taken in the direction of the arrows 12—12 of FIG. 11, of a perforating rule for forming one of the nicking connectors, parts of the cutting rule adjacent the perforating rule also being shown.
Figure 13:
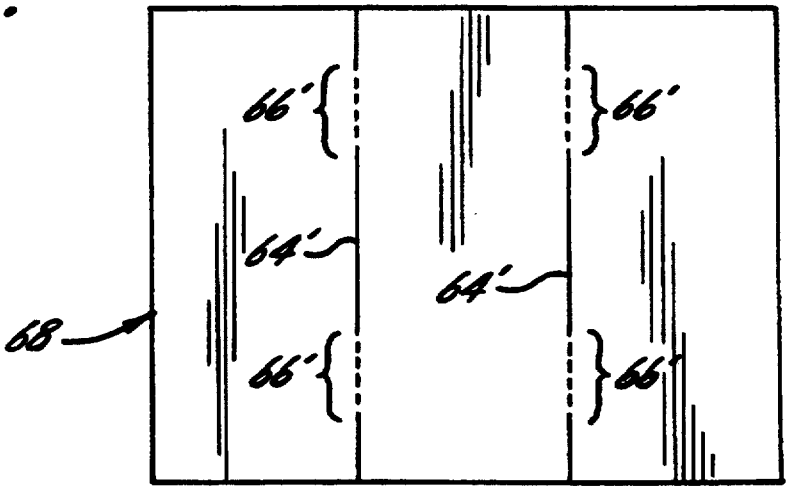
FIG. 13 is a top plan view of a paperboard sheet having nicking connectors formed by the apparatus of FIG. 11.

FIG. 11 of the drawings shows a die assembly upon die board 26 that is adapted to form, from a conventional sheet of paperboard material (not shown), a panel having three laterally adjacent sections that are interconnected by "nicking" connectors. The die assembly includes conventional toothed peripheral cutting rules 62 and interior rules 64 that may be and illustratively are of the same construction as rule 62 except for their having, at spaced locations along their length, means 66 for forming nicking connections between multiple like things such as the three adjacent panels 68 of the paperboard sheet shown in FIG. 13. As is well known to those skilled in the art, a nicking connection in a cutting rule member is usually formed by providing a slot that is disposed within and that opens from the outer edge portion of the rule member. This frequently does not produce a nicking connection that separates in the desired manner. In accordance with the present invention, the improved means 66 for forming nicking connections that readily separate consists of sharpened pointed teeth that may be and preferably are of the same type as the teeth 46 shown in FIGS. 5 and 6 of the drawings. The teeth 46 project outwardly from the cutting rules 64 with which they are associated and form slits 66' (FIG. 13) at those locations in a panel 68 where nicking connections are desired. The length of the slits 66' can be readily adjusted, in any of the ways previously noted, so as to cause the nicking connections to perform their desired function of maintaining the panel sections together during their passage through the anvil and die rolls of the apparatus, while permitting neat and easy separation of the panel sections from each other following their passage through such rolls.

Figure 16:
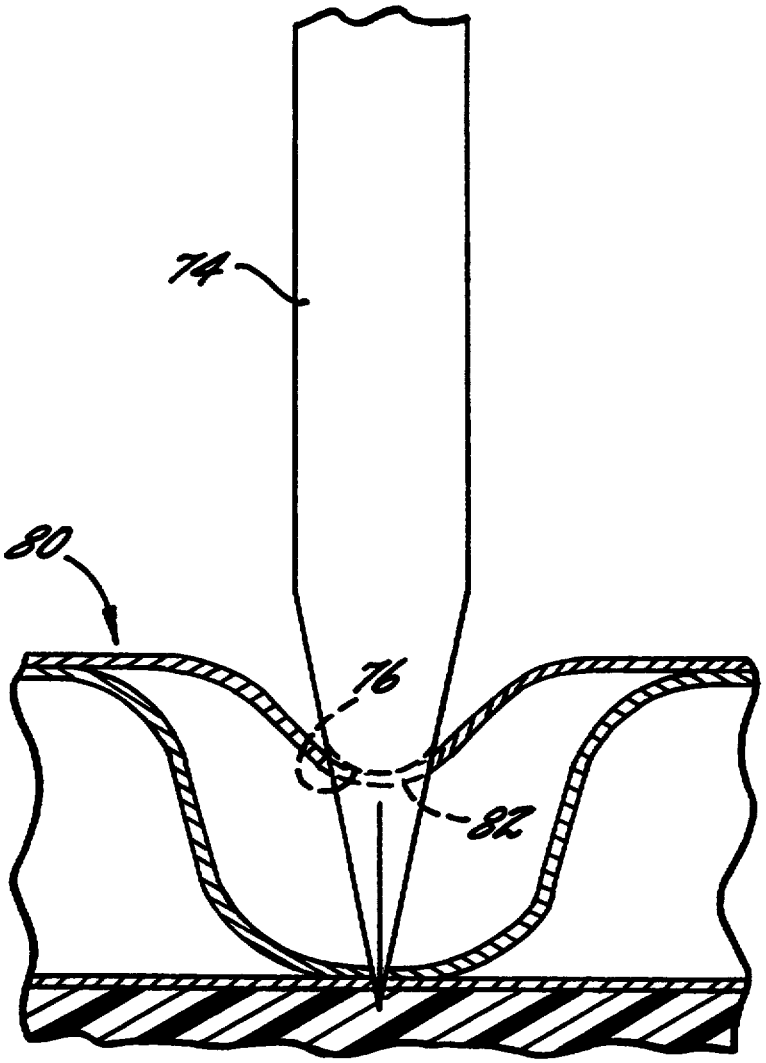
FIG. 16 is a side view of a slit scoring and creasing rule shaping a paperboard sheet.

FIGS. 14 and 15 show combination slit-scoring and creasing rules that are of substantially the same construction except for the rule 70 of FIG. 14 being straight and the rule 70' of FIG. 15 being curved. The numerals used in the following description of components of the rule 70 are therefore also used, with the addition of a prime designation, to identify corresponding components of rule 70'. Rule 70 has a body 72 whose inner (lower, as viewed in FIG. 14) edge portion is secured in a conventional manner to, and projects outwardly from, the die roll (not shown in FIG. 14) of the rotary die apparatus. A plurality of sharp, laterally tapered, pointed teeth 74, which are similar to or the same as the previously described teeth 46, project outwardly from the outer (upper, as viewed in FIG. 14) edge 76 of the rule. At least some (and illustratively all) laterally adjacent ones of the teeth 74 are separated from each other by intervening spaces 78. The sections of rule outer edge 76 within spaces 78 are free from sharp edges and the like, and preferably have smooth and rounded outer surfaces. Referring now also to FIG. 16 of the drawings, during use of rule 72 its teeth 74 slit score a paperboard sheet S0 in the same manner as previously described with respect to teeth 46. Additionally, and substantially simultaneously, the sections of outer edge 76 within space 78 engage and form aligned creases 82 (only one of which is shown in FIG. 16) within the inner (upper, as shown in FIG. 16) part of the sheet. The slits formed in sheet 80 are generally parallel to, and alternate with the creases 82, and line in a common vertical (as viewed in FIG. 16) plane. The slits significantly decrease the possibility of "wandering" of the creases, even when they extend parallel to the flutes of sheet 80.

While preferred embodiments of the invention have been shown and described, this was for purposes of illustration only, and not for purposes of limitation, the scope of the invention being in accordance with the following claims.

We claim:

1. A rotary die apparatus for shaping corrugated paperboard sheets each having a corrugated ply having elongated corrugations, and inner and outer liner plies respectively overlying inner and outer opposite sides of said corrugated ply, said apparatus comprising:

a die roll and an anvil roll extending in parallel relationship to each other and defining therebetween a nip through which said sheets pass;

drive means for rotating said rolls in opposite directions during operation of said apparatus;

a die board mounted upon said die roll for rotation therewith;

die members mounted upon and projecting outwardly from said die board;

said die members including a perforating rule having a base section secured to said die board, and a plurality of sharp pointed laterally tapered, laterally adjacent teeth connected to and extending outwardly from said base section;

said teeth of said perforating rule having a length sufficient to penetrate said outer liner ply and form aligned discontinuous slits in said inner liner ply.

2. A rotary die apparatus as in claim 1, wherein each of said teeth has sloping sharpened sides.

3. A rotary die apparatus as in claim 1, wherein said teeth are each of generally triangular shape.

4. A rotary die apparatus as in claim 1, wherein said teeth of said perforating rule have a pitch within the range of 4–6 teeth per inch.

5. A rotary die apparatus as in claim 1, wherein said die members upon said die board further include at least one from the group comprised of cutting rules, trim breakers, scrap ejectors and product ejectors.

6. A rotary die apparatus as in claim 1, wherein said perforating rule extends in transverse relationship to said corrugations of said sheets.

7. A rotary die apparatus as in claim 1, wherein said perforating rule extends in transverse relationship to the direction of travel of said sheets through said nip.

8. A rotary die apparatus as in claim 1, wherein said perforating rule has discrete opposite first and second ends.

9. A rotary die apparatus as in claim 1, including a second one of said perforating rules extending in laterally spaced and generally parallel relationship to said first-mentioned one of said perforating rules, the pitch of said teeth of said first perforating rule being different from the pitch of said teeth upon said second one of said perforating rules.

10. A rotary die apparatus as in claim 1, wherein said teeth each have opposite side edges defining substantially equal angles with a plane bisecting said tooth.

11. A rotary die apparatus as in claim 1, wherein said perforating rule extends in substantially parallel relationship to said corrugations of said sheet.

12. A die rule for cutting and creasing a paperboard sheet during passage thereof through the nip between rotating die and anvil rolls of a rotary die apparatus, said rule comprising:

a body connected to said die roll and having an outer edge adjacent said anvil roll;

laterally tapered, laterally adjacent tooth elements extending outwardly from said outer edge of said body, said tooth elements being of a length sufficient to penetrate an outer ply liner of said paperboard sheet during said passage thereof through said nip;

at least some laterally adjacent ones of said tooth elements having therebetween open spaces bordered by sections of said outer edge of said body;

said sections of said outer edge of said body within said open spaces between said teeth engaging and creasing said paperboard sheet during said passage thereof through said nip between said die and anvil rolls of said rotary die apparatus.

13. A die rule as in claim 12, wherein said tooth elements have sharpened side edges.

14. A die rule as in claim 12, wherein said tooth elements are of generally triangular shape.

15. A die rule as in claim 12, wherein said tooth elements are pointed.

16. A die rule as in claim 12, wherein said teeth have a pitch within the range of about four to six per inch.

17. A die rule as in claim 16, wherein said outer edge of body is substantially free of sharp edges.

18. A method for shaping a corrugated paperboard sheet comprising a corrugated ply having elongated corrugations and inner and outer liner plies respectively overlying inner and outer opposite sides of said corrugated ply, the method comprising:

passing said corrugated ply through a nip defined by a die roll and an anvil roll extending in parallel relationship to each other, said die and anvil rolls rotating in opposite directions, said die roll carrying at least one die rule having a base section secured to said die roll and a plurality of sharp pointed laterally tapered, laterally adjacent teeth connected to and extending outwardly from said base section, penetrating said outer liner ply and forming aligned discontinuous slits in said inner liner ply with said teeth.

19. A method as in claim 18, wherein each of said teeth has sloping sharpened sides.

20. A method as in claim 18, wherein said teeth are each of generally triangular shape.

21. A method as in claim 18, wherein said teeth of said perforating rule have a pitch within the range of 4–6 teeth per inch.

22. A method as in claim 18, wherein said die roll further includes at least one from the group comprised of cutting rules, trim breakers, scrap ejectors and product ejectors.

23. A method as in claim 18, wherein said die rule extends in transverse relationship to said corrugations of said sheets.

24. A method as in claim 18, wherein said die rule extends in substantially parallel relationship to said corrugations of said sheet.

25. A method as in claim 18, wherein said die rule extends at an angle oblique to said corrugations of said sheet.

26. A method as in claim 18, wherein said die rule extends in transverse relationship to the direction of travel of said sheets through said nip.

27. A method as in claim 18, wherein said die rule has discrete opposite first and second ends.

28. A method as in claim 18, including a second one of said die rules extending in laterally spaced and generally parallel relationship to said first-mentioned one of said die rules, the pitch of said teeth of said first die rule being different from the pitch of said teeth upon said second one of said die rules.

29. A method as in claim 18, wherein said teeth each have opposite side edges defining substantially equal angles with a plane bisecting said tooth.

30. A method as in claim 18, wherein said die rule extends in substantially parallel relationship to said corrugations of said sheet.

31. A method of cutting and creasing a paperboard sheet having a corrugated ply having elongated corrugations and inner and outer liner plies respectively overlying inner and outer opposite sides of said corrugated ply, the method comprising:

passing said corrugated ply through a nip defined by a die roll and an anvil roll extending in parallel relationship to each other, said die and anvil rolls rotating in opposite directions, said die roll carrying at least one die rule comprising a body connected to said die roll having an outer edge extending outwardly from said die roll and laterally tapered, laterally adjacent tooth elements extending outwardly from said body, at least some laterally adjacent ones of said tooth elements having therebetween open spaces bordered by sections of said outer edge of said body, penetrating said outer liner ply with said teeth during said passage thereof through said nip, and engaging and creasing said paperboard sheet during passage thereof through said nip with said sections of said outer edge of said body within said open spaces between said teeth.

32. A method as in claim 31, wherein each of said teeth has sloping sharpened sides.

33. A method as in claim 31, wherein said teeth are each of generally triangular shape.

34. A method as in claim 31, wherein said teeth of said perforating rule have a pitch within the range of 4–6 teeth per inch.

35. A method as in claim 31, wherein said die roll further includes at least one from the group comprised of cutting rules, trim breakers, scrap ejectors and product ejectors.

36. A method as in claim 31, wherein said die rule extends in transverse relationship to said corrugations of said sheets.

37. A method as in claim 31, wherein said die rule extends in transverse relationship to the direction of travel of said sheets through said nip.

38. A method as in claim 31, wherein said die rule has discrete opposite first and second ends.

39. A method as in claim 31, wherein said teeth each have opposite side edges defining substantially equal angles with a plane bisecting said tooth.

40. A method as in claim 31, wherein said die rule extends in substantially parallel relationship to said corrugations of said sheet.

41. A method as in claim 31, wherein said die rule extends at an oblique angle to said corrugations of said sheet.

* * * * *

UNITED STATES PATENT AND TRADEMARK OFFICE

CERTIFICATE OF CORRECTION

PATENT NO. : 5,429,577

DATED : July 4, 1995

INVENTOR(S) : Simpson et al.

It is certified that error appears in the above-identified patent and that said Letters Patent is hereby corrected as shown below:

Column 7 line 27, "SO" should be --80--.

Signed and Sealed this

Twelfth Day of March, 1996

Bruce Lehman

*Attest:*

BRUCE LEHMAN

*Attesting Officer*

*Commissioner of Patents and Trademarks*